US009060634B1

(12) United States Patent
Medwynter et al.

(10) Patent No.: US 9,060,634 B1
(45) Date of Patent: Jun. 23, 2015

(54) UNIVERSAL SLEEVE SUPPORTER AND METHOD FOR MANUFACTURING A SLEEVE SUPPORTER

(71) Applicants: Philip Edward Medwynter, London (GB); Ivor E. Noicely, Miramar, FL (US)

(72) Inventors: Philip Edward Medwynter, London (GB); Ivor E. Noicely, Miramar, FL (US)

( * ) Notice: Subject to any disclaimer, the term of this patent is extended or adjusted under 35 U.S.C. 154(b) by 0 days.

(21) Appl. No.: 14/094,866

(22) Filed: Dec. 3, 2013

Related U.S. Application Data

(60) Provisional application No. 61/733,055, filed on Dec. 4, 2012.

(51) Int. Cl.
*A47G 25/20* (2006.01)
*B65D 85/18* (2006.01)
*A47F 8/02* (2006.01)

(52) U.S. Cl.
CPC . *A47G 25/20* (2013.01); *A47F 8/02* (2013.01); *B65D 85/18* (2013.01)

(58) Field of Classification Search
CPC ..... A47G 25/20; B65D 85/18; B65D 85/182; A47F 8/02; A47F 7/19
USPC ..... 223/37, 38, 66, 71, 74, 84; 206/292, 206/295, 495
See application file for complete search history.

(56) References Cited

U.S. PATENT DOCUMENTS

| | | | | |
|---|---|---|---|---|
| 1,720,679 | A * | 7/1929 | Karn | 206/295 |
| 1,782,057 | A * | 11/1930 | Bollinger | 24/301 |
| 2,004,362 | A * | 6/1935 | Becht | 223/71 |
| 2,081,356 | A * | 5/1937 | Hiss | 223/71 |
| 2,586,909 | A * | 2/1952 | Blackman | 223/74 |
| 3,015,422 | A | 1/1962 | De Fino | |
| 3,057,462 | A * | 10/1962 | Rouder | 206/294 |
| 3,101,842 | A * | 8/1963 | Sydnor | 206/295 |
| 4,030,645 | A | 6/1977 | Wolf | |
| 4,134,524 | A * | 1/1979 | Nakano et al. | 223/71 |
| 4,285,427 | A * | 8/1981 | Webinger | 206/292 |
| 4,901,893 | A * | 2/1990 | Conran et al. | 223/66 |
| 5,096,100 | A * | 3/1992 | King et al. | 223/84 |
| 5,148,955 | A | 9/1992 | Cares | |
| 6,164,504 | A | 12/2000 | Richard | |
| 6,173,871 | B1 | 1/2001 | Woodworth | |
| 6,401,992 | B1 | 6/2002 | Harrod et al. | |
| 6,758,378 | B2 | 7/2004 | Carmichael | |
| 7,658,016 | B2 | 2/2010 | Schulkin | |
| 8,177,106 | B2 | 5/2012 | Betts | |
| 2008/0257920 | A1 | 10/2008 | Spencer | |

* cited by examiner

*Primary Examiner* — Ismael Izaguirre

(74) *Attorney, Agent, or Firm* — H. John Rizvi; Gold & Rizvi P.A.

(57) ABSTRACT

A universal sleeve supporter for keeping a suit jacket sleeve from creasing or wrinkling while the jacket is mounted on a hanger. The supporter comprises a planar structure stamped out of a firm yet flexible material in a manner to include a hanger engaging opening therein for engaging the supporter about a hanger when not in use and a clip which is foldable to either side of the structure, being engaged to the supporter structure by a hinge stamped into the material thereof. The supporter has scored side edge sections along each side edge of a lower section thereof, the scored side edge sections including a plurality of score lines therein about which the side edge sections may be folded inwardly to accommodate a sleeve of lesser diameter than that of the lower section.

20 Claims, 8 Drawing Sheets

UNIVERSAL SLEEVE SUPPORTER AND METHOD FOR MANUFACTURING A SLEEVE SUPPORTER

CROSS-REFERENCE TO RELATED APPLICATIONS

This Non-Provisional Utility Patent Application claims priority to U.S. Provisional patent application Ser. No. 61/733,055 filed on Dec. 4, 2012, which is incorporated herein in its entirety.

FIELD OF THE INVENTION

The present invention relates to a universal sleeve supporter, a planar structure for making the sleeve supporter and a method for making the sleeve supporter. The supporter is placed within the sleeve of a suit or other garment and includes a clip for engaging the supporter over an arm seam to keep the sleeve from wrinkling or creasing when the garment is hung.

BACKGROUND OF THE INVENTION

Heretofore, suit sleeve supporters for use in automated jacket sewing apparatus have been proposed. As an example, a suit sleeve supporter has been proposed for use in a complex, computerized, robotic suit jacket sewing apparatus in U.S. Pat. No. 4,915,040. Also, various support apparatus for use in manufacturing processes for forming long tubular pieces of fabric and/or knit material have been proposed. However, no suit sleeve support for use in keeping a suit sleeve from wrinkling or creasing while on a hanger has been heretofore proposed.

SUMMARY OF THE INVENTION

The present invention overcomes problems that remain unsolved by providing a universal sleeve supporter for keeping a sleeve of a garment from wrinkling or creasing while the garment is positioned on a hanger. The present invention also provides a scored planar structure from which to obtain a universal sleeve supporter, and a method for obtaining a universal sleeve supporter from an initial scored planar structure.

In accordance with one implementation of the present invention, the invention comprises a universal sleeve supporter for use in keeping a sleeve of a suit jacket or the like from creasing or wrinkling while the suit jacket is mounted on a hanger, the supporter comprising:

a planar structure made of a firm yet flexible material and being stamped from such material in a manner to include:

a clip portion which is foldable outwardly from an upper section of the planar structure, to either side of the structure; and scored side edge sections, one along each side of a lower section of the planar structure, the scored side edge sections including a plurality of score lines therein about which the side edge sections may be folded inwardly to accommodate placement into a sleeve of lesser diameter than a diameter of the supporter lower section.

In a second aspect, the clip portion is engaged to the supporter by a hinge stamped into the material thereof In another aspect, the planar structure further comprises a hanger engaging opening therein for engaging the supporter about a hanger when not in use.

In another aspect, there is disclosed the blank for planar structure rom which the universal sleeve supporter is created.

In another aspect, there is disclosed the method of making the universal sleeve supporter.

In another aspect, there is disclosed the method of using the universal sleeve supporter.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The invention refers to a sleeve supporter for use in keeping a sleeve of a garment from creasing or wrinkling while the garment is mounted on a hanger. The sleeve supporter can be directly manufactured in a three-dimensional shape or, alternatively, can be manufactured from a scored, foldable planar structure capable of being folded to adopt a three-dimensional shape as will be explained hereafter.

Figure 1:
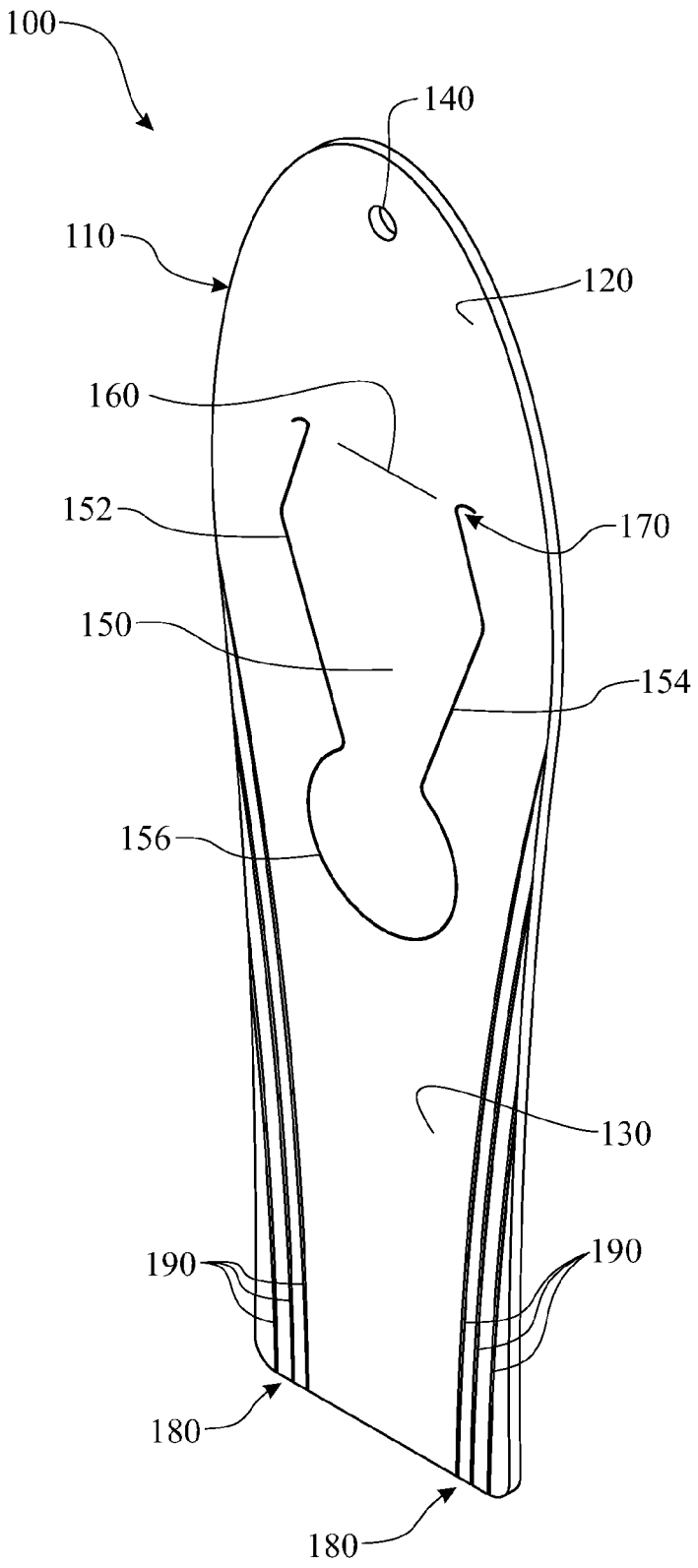
FIG. 1 presents a perspective view of a first embodiment of a sleeve supporter according to the invention, shown in a first position in which the clip has not yet been folded out from the sleeve supporter planar structure.

The illustration of FIG. 1 shows a perspective view of a first embodiment of a sleeve supporter 100 according to the invention, shown in a first position in which the sleeve supporter 100 is flatly arranged and yet to be folded so that it can be used for supporting a sleeve. The sleeve supporter 100 comprises a planar structure 110 that has an upper section 120 and a lower section 130. The upper section 120 integrates therein a clip 150 that is secured to the upper section 120 by a unitary or living hinge 160 which engages an upper edge 170 of the clip 150 to the upper section 120. The clip 150 is outwardly foldable to either side of the upper section 120, so as to be accommodating to use in either sleeve of a garment, as will be shown in further figures. In turn, the lower section 130 has scored side edge sections 180 which are foldable inwardly or outwardly, over the lower section 130, as necessary. Being able to fold the scored side edge sections 180 allows to vary the width of the lower section 130 and thus to accommodate placement into sleeves of smaller diameter, such as those found in women's suit jackets.

Preferably, as shown, opposite edges 152, 154 of the clip 150 are not straight and are irregularly shaped in order to prevent the clip 150 from slipping out of the sleeve once the sleeve supported is installed inside the garment. For instance, in the embodiment shown in the figure, the edges 150, 154 are formed of portions arranged in different directions, and terminated in a final round end 156. The round end 156 further helps the clip 150 to be able to be smoothly inserted in the garment, as will be understood in further figures.

In a preferred embodiment, the scored side edge sections 180 each include at least one score line 190—three, in the present embodiment—along which a user may fold the scored side edge sections 180 once or more than once, depending on the number of score lines 190 provided. Having different score lines 190 facilitates folding the scored side edge sections 180 and can also provide for predetermined folding of the sleeve supporter 100 into different sleeve diameters, and thus for the sleeve supporter 100 to be adapted to different predetermined garment sizes. It will further be understood that the score lines 190 are created in a manner to allow the scored side edge sections 180 to fold to either side of the lower section 130, and preferably to a side opposite that to which the clip 150 is folded, in a preferred embodiment.

Figure 2:
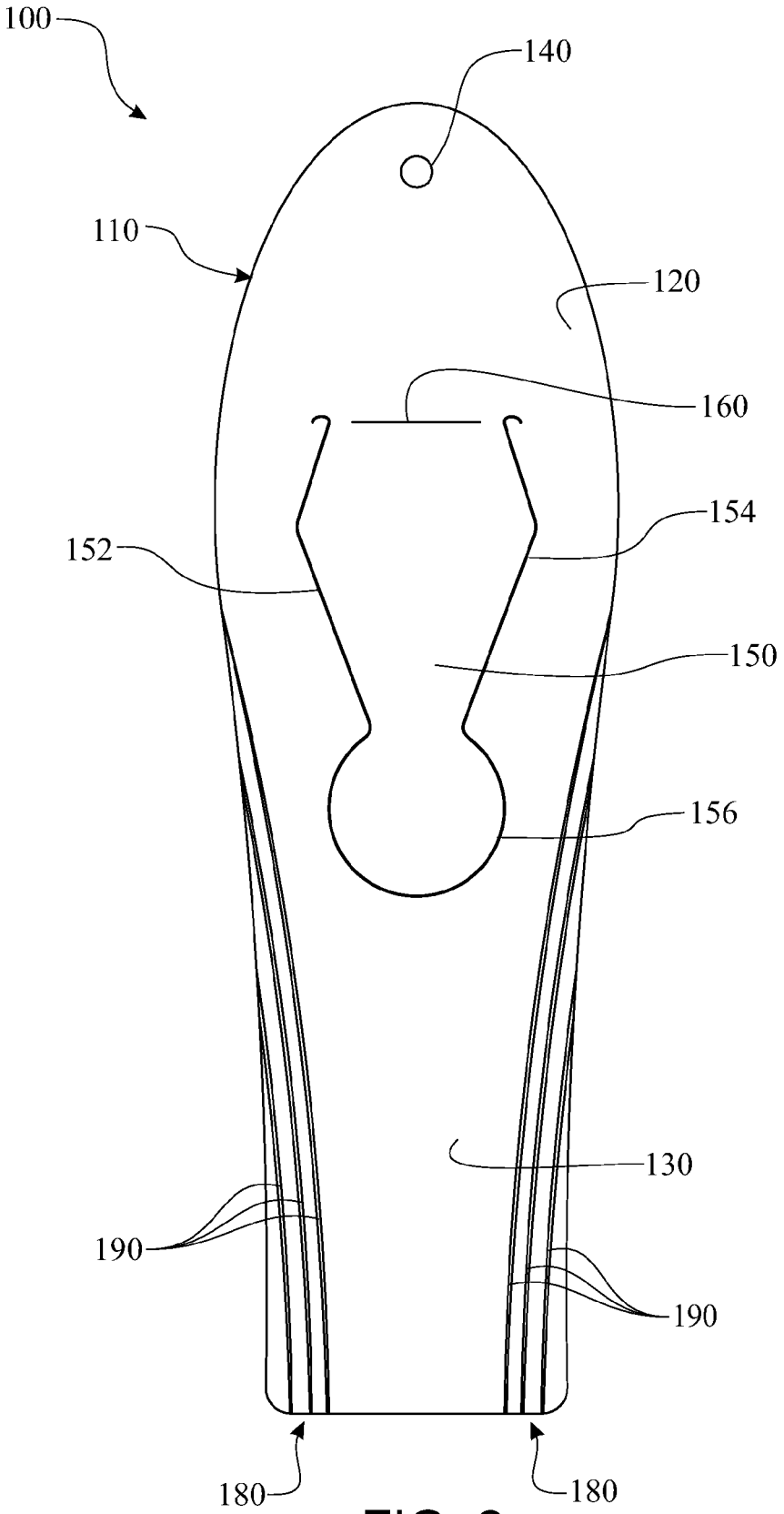
FIG. 2 presents an elevated front view of the sleeve supporter of FIG. 1.
Figure 3:
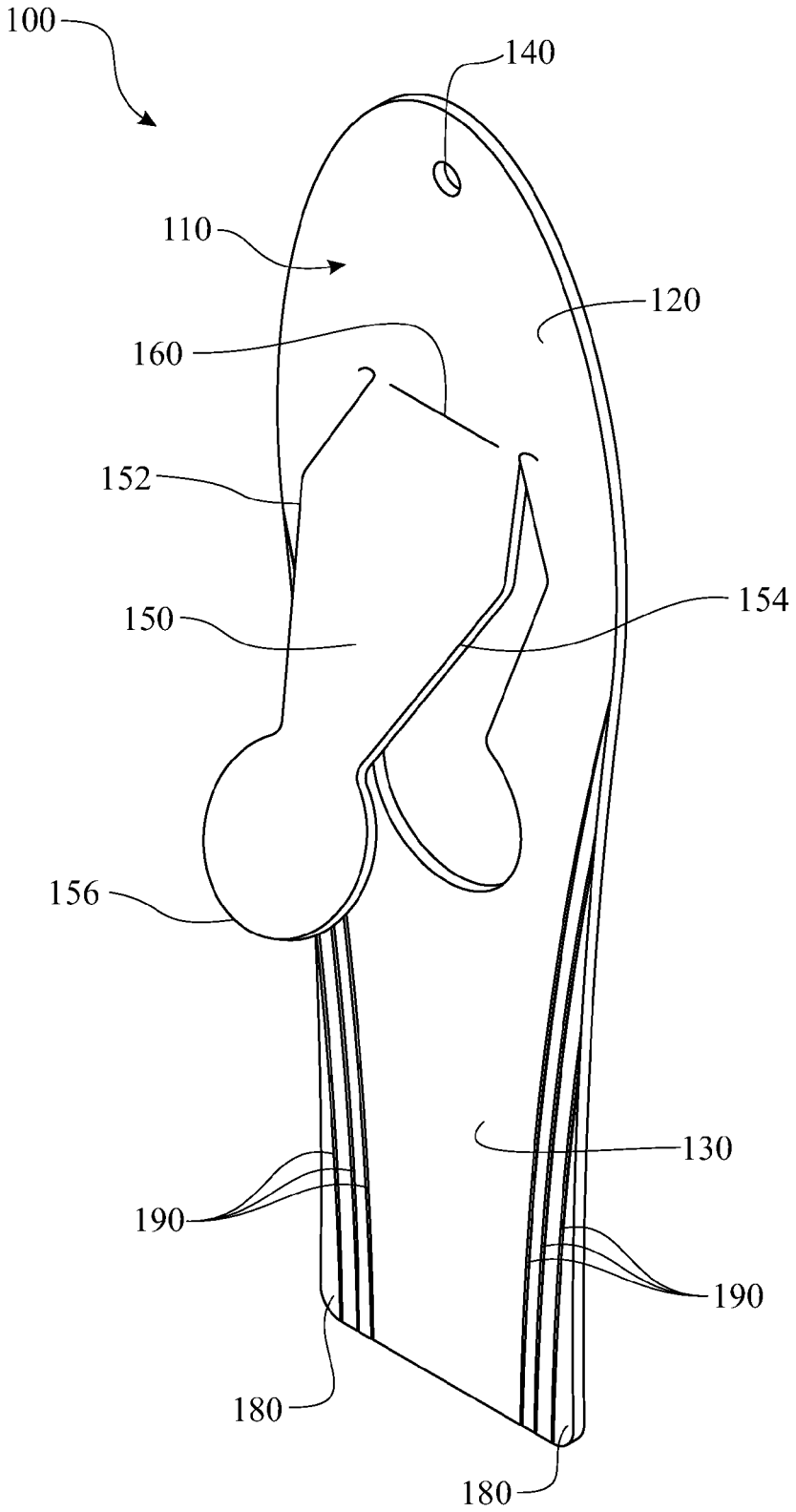
FIG. 3 presents the sleeve supporter of FIG. 1, in a second position in which the clip has been folded out of the planar structure and thus the sleeve supporter is ready to be fitted into a sleeve of a garment.
Figure 4:
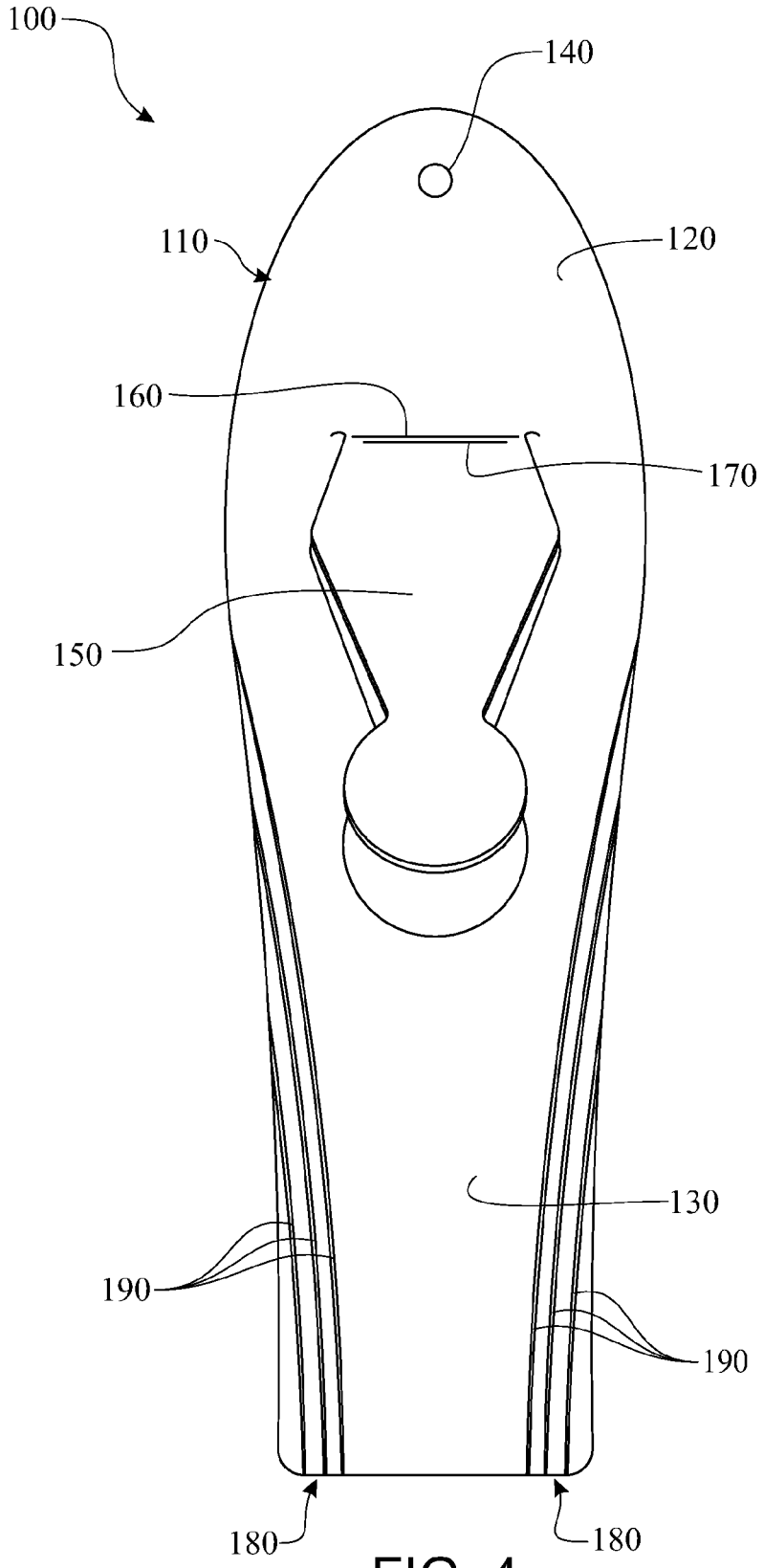
FIG. 4 presents an elevated front view of the sleeve supporter of FIG. 3.
Figure 5:
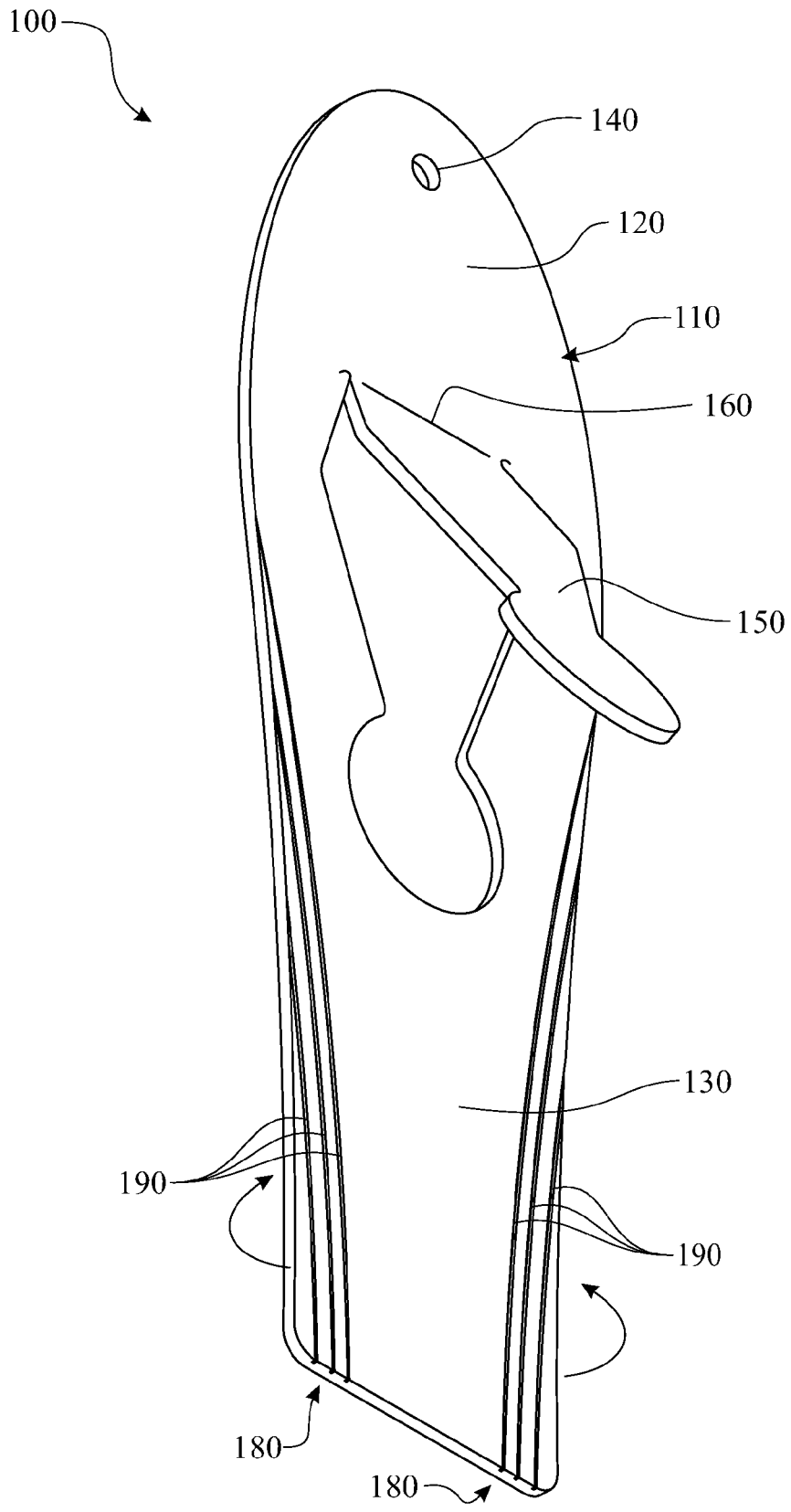
FIG. 5 presents an additional perspective view of the sleeve supporter of FIG. 3.
Figure 6:
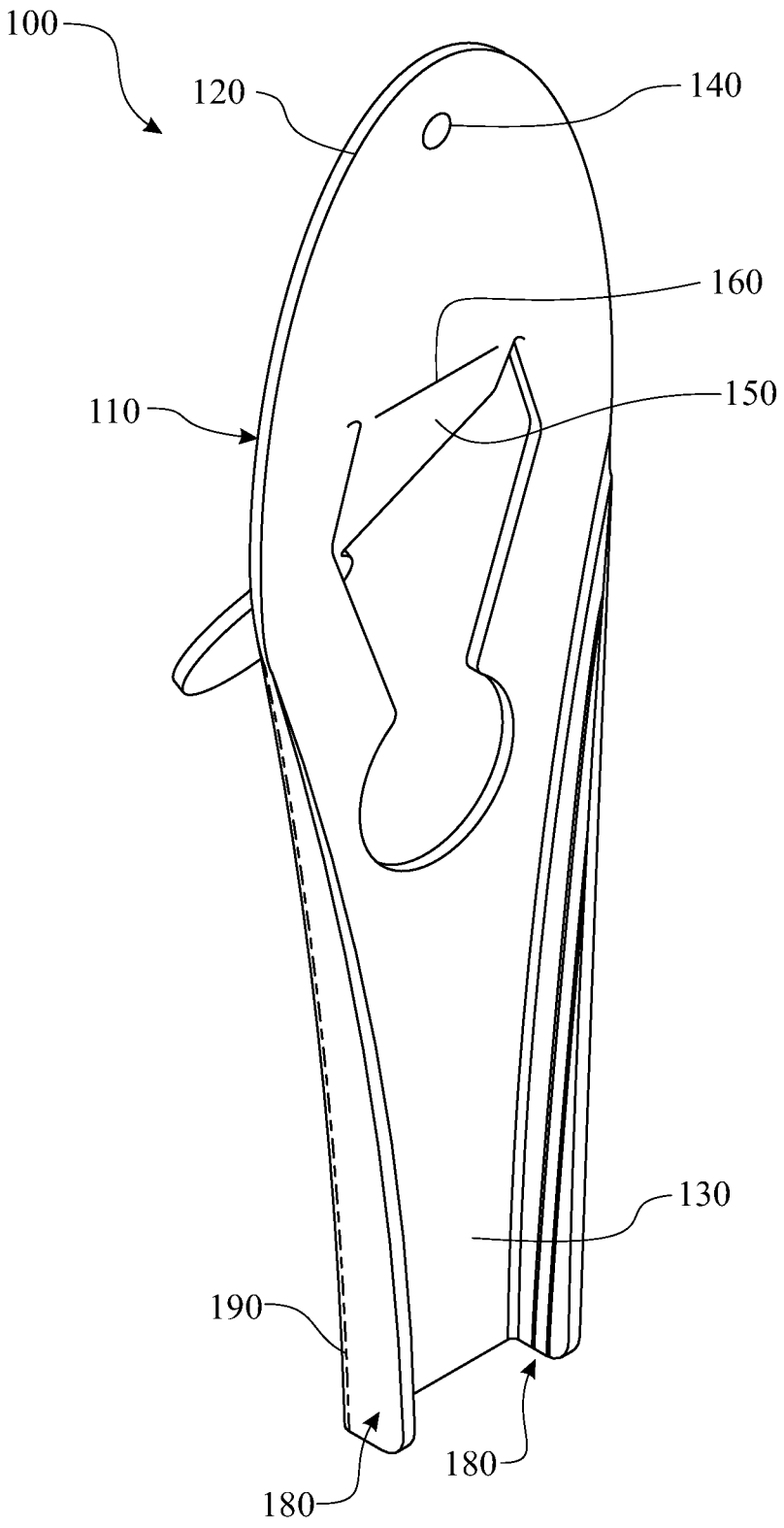
FIG. 6 presents a perspective view of the sleeve supporter of FIG. 1, shown in a third position in which side edge sections have been folded inwards along respective scored lines in order to reduce the width of the sleeve supporter and allow the supporter to accommodate inside a sleeve of smaller diameter.

The illustrations of FIGS. 1 through 6 show a sequence for preparing the sleeve supporter 100 so that it is ready to be placed inside the sleeve of a garment. In FIGS. 1 and 2, the sleeve supporter 100 is shown in an initial position in which it is flatly arranged, and none of the foldable elements therein have been folded outwards. The drawings of FIGS. 3 through 5, in turn, show the sleeve supporter 100 in a second position in which the clip 150 has been pulled out so that it folds outwardly along the hinge 160 forming an acute angle with the planar structure 110. In this second position, the sleeve supporter 100 is no longer flat, and is ready to be installed inside the sleeve of a garment. If, however, the sleeve had a small diameter (such as that of a woman's jacket sleeve), the sleeve supporter 100 would probably still have to be adjusted one step further, as shown in FIG. 6, by folding the scored side edge sections 180 rearwards, along a respective score line 190. By rearwards, it is understood that the scored side edge sections 180 have been folded in a direction opposite to that of the clip 150. The width of the lower section 130 is thus reduced and the lower section 130 is now capable of fitting into a narrower sleeve.

Figure 7:
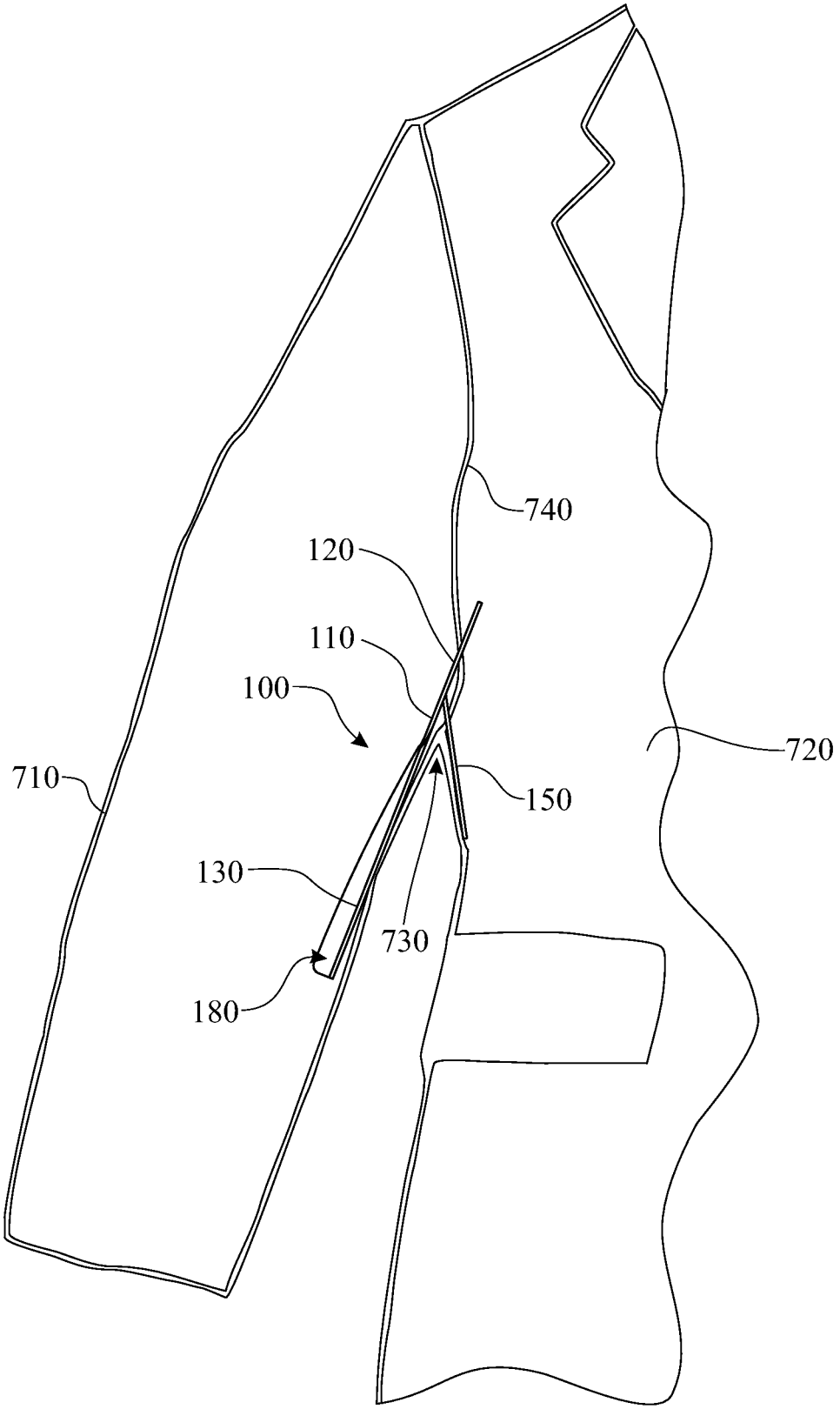
FIG. 7 presents a perspective view of the exemplary sleeve supporter as previously presented in FIG. 6, showing the sleeve supporter in its environment of use, being hung into a sleeve with the clip thereof engaging over the arm seam of a suit into the sleeve of which the sleeve supporter has been inserted.

The illustration of FIG. 7 shows the sleeve supporter 100 of FIG. 6 placed inside a sleeve 710 of a suit 720. As can be observed, the planar structure 110 is placed against an inner surface of the sleeve 710, and the clip 150 secures the sleeve supporter 100 by engaging over a bottom section or juncture 730 of a sleeve seam 740. When the sleeve supporter 100 is properly seated, the lower section 130 of the sleeve supporter 100 lies along the inner surface of the sleeve 710 while the upper section 120 extends outwardly of the sleeve 710 and into the suit 720 itself.

As shown in FIGS. 1 through 6, the upper section 120 of the planar structure 110 can further include a hanger engaging opening 140 which allows the sleeve supporter 100 to be stored on a hanger (not shown) when not in use.

The universal sleeve supporter 100 is preferably made of a stiff yet flexible material, such as card or sheet PVC, though this should not be construed as limiting. The planar structure 110 for the universal sleeve supporter 100 is, in a preferred embodiment, stamped out of such material, with the foldable clip 150, foldable scored side edge sections 180 and hanger engaging opening 140 being created during the stamping process. Thus, the foldable clip 150 will be formed by incorporating the hinge 160 and the scored side edge sections will be formed by incorporating the score lines 190 during stamping. It will also be understood that the planar structure 110 provides a planar area which lends itself to branding, should such be desired. The planar structure 110 for the universal sleeve supporter 100 may be packaged for delivery in any suitable fashion, for instance in packs of multiple planar structures 110 arranged in parallel alignment.

In an alternative embodiment, the sleeve supporter can be manufactured directly in a three-dimensional shape, for instance manufactured by plastic injection molding.

Figure 8:
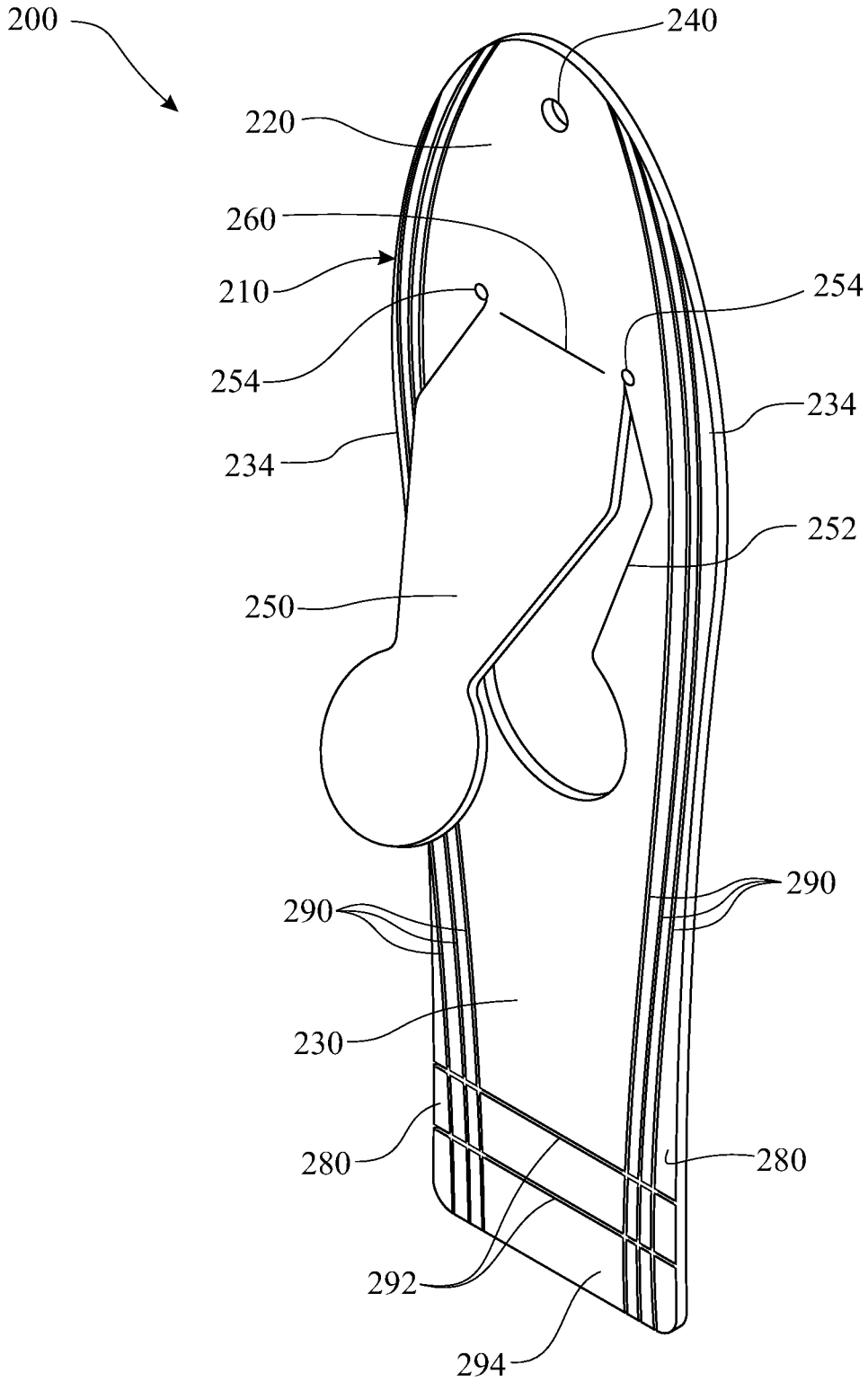
FIG. 8 presents a second embodiment of a sleeve supporter according to the invention.

The drawing of FIG. 8 depicts a further embodiment of the invention, consisting of a sleeve supporter 200 provided with a planar structure 210 having an upper section 220 and a lower section 230, a hanger engaging opening 240, and a clip 250 outwardly foldable from the upper section 230 along a hinge 260. The clip 250 is formed by a cut-out 252 in the planar structure 210, the cut-out 252 terminating in respective end loop cut-outs 254 that eliminate focused tension points between the clip 250 and the planar structure 210 and thus reduce the risk of tearing or ripping at the ends of the hinge 260. The end loop cut-outs 254 are preferably in shape of a circle, for simplicity of manufacture (for instance, by punching a rod through the planar structure 200).

In addition, the sleeve supporter 200 of the present embodiment comprises score lines 290 that extend longitudinally from the lower section 230 to the upper section 220. This allows not only to vary the width of the lower section 230 by folding the lower scored side edge sections 280 along the score lines 290, but also to vary the width of the upper section 220 by folding upper side edge sections 234 along said score lines 290. In the embodiment shown, the score lines 290 along which the upper side edge sections 234 and the lower side edge sections 280 fold are continuous, extending from the lower section 230 to the upper section 220. However, the invention contemplates alternative embodiments in which the score lines are discontinuous and/or do not extend from the lower section 230 to the upper section 220. For instance, there could be a set of score lines in the lower section 230, and a different set of score lines in the upper section 220.

The sleeve supporter 200 of the present embodiment further comprises transversal score lines 292 allowing to fold an end portion 294 of the planar structure 210. The transversal score lines 292 shown in the figure are arranged in the lower section 230 of the planar structure 210. However, the invention contemplates that transversal score lines could also, or alternatively, be present in the upper section 220 of the planar structure. Having foldable end portions 294 capable of being folded along transversal score lines 192 allows to vary the total length of the sleeve supporter 200, and thus to adapt the product to different sleeve lengths.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims

What is claimed is:

1. A sleeve supporter for use in keeping a sleeve of a garment from creasing or wrinkling while the garment is mounted on a hanger, the supporter comprising:

a planar structure made of a firm yet flexible material, said planar structure comprising a topmost end and a bottommost end, and wherein said planar structure is stamped from such material in a manner to include:

a clip portion which is foldable outwardly from an upper section of the planar-structure-, to either side of the planar structure, from an unfolded position in which said clip portion is coplanar to said planar structure to a folded position in which said clip portion is folded outwardly from said planar structure, said clip portion comprising an upper end and a lower end, wherein said upper end is secured to the planar structure;

a bottom section, extending from said lower end of said clip portion in said unfolded position to said bottommost end of said planar structure, wherein said bottom section is free of transverse score lines arranged closer to said lower end of said clip portion in said unfolded position than to said bottommost end of said planar structure; and a foldable side edge section along at least one side of a lower section of the planar structure, the side edge section being foldable to vary the width of the lower section.

2. The sleeve supporter of claim 1, wherein the lower section of the planar structure further comprises at least one score line about which the side edge sections may be folded.

3. The sleeve supporter of claim 1, wherein said upper end of said clip portion is engaged to the planar structure by a hinge stamped into the material thereof.

4. The sleeve supporter of claim 1, further comprising a hanger engaging opening therein for engaging the supporter about a hanger when not in use.

5. The sleeve supporter of claim 1, wherein the clip is foldable in outwardly from the planar structure oppositely to the at least one foldable side edge section.

6. The sleeve supporter of claim 1, wherein the clip is formed by a cut-out in the planar structure, the cut-out terminating in respective end loop cut-outs.

7. The sleeve supporter of claim 1, wherein the upper section of the planar structure further comprises side edge sections, along at least one side of said upper section, the side edge sections being foldable to vary the width of the upper section.

8. The sleeve supporter of claim 7, wherein the upper section of the planar structure further comprises at least one score line about which the side edge sections may be folded.

9. The sleeve supporter of claim 1, wherein said bottom section extending from said lower end of said clip in said unfolded position to said bottommost end of said planar structure is free of transverse score lines along a length of said entire bottom section.

10. The sleeve supporter of claim 1, wherein said bottom section comprises at least one transverse score line arranged closer to said bottommost end of said planar structure than to said lower end of said clip in said unfolded position, said at least one transverse score line defining at least one end portion that is foldable in order to vary the length of the planar structure.

11. A sleeve supporter for use in keeping a sleeve of a garment from creasing or wrinkling while the garment is mounted on a hanger, the sleeve supporter comprising:

a body structure having a topmost end and a bottommost end;

a clip portion which protrudes outwardly from an upper section of the body structure forming an acute angle with said body structure, said clip portion comprising an upper end secured to the body structure and a protruding lower end; and a foldable side edge section along at least one side of a lower section of the body structure, the side edge section being foldable to vary the width of the lower section; wherein said body structure is free of transverse score lines arranged between said lower end of said clip portion and said bottommost end of said planar structure, and closer to said lower end of said clip portion than to said bottommost end of said planar structure.

12. The sleeve supporter of claim 11, wherein the lower section of the body structure further comprises at least one score line about which the side edge sections may be folded.

13. The sleeve supporter of claim 11, further comprising a hanger engaging opening therein for engaging the supporter about a hanger when not in use.

14. The sleeve supporter of claim 11, wherein the side edge sections are foldable oppositely to the clip.

15. The sleeve supporter of claim 11, wherein the upper section of the body structure further comprises side edge sections, along at least one side of said upper section, the side edge sections being foldable to vary the width of the upper section.

16. The sleeve supporter of claim 15, wherein the upper section of the body structure further comprises at least one score line about which the side edge sections may be folded.

17. The sleeve supporter of claim 11, wherein said body structure is free of transverse score lines arranged between said lower end of said clip portion and said bottommost end of said body structure the body structure.

18. The sleeve supporter of claim 11, wherein said body structure comprises at least one transverse score line arranged between said lower end of said clip portion and said bottommost end of said body structure and closer to said bottommost end of said body structure than to said lower end of said clip portion, said at least one transverse score line defining at least one end portion that is foldable in order to vary the length of the body structure.

19. A method for manufacturing a sleeve supporter, comprising the steps of:

stamping a planar structure out of a stiff yet flexible material, said planar structure comprising a topmost end and a bottommost end, said stamping including:

stamping a clip portion and a hinge, said clip portion comprising a clip upper end and a clip lower end, wherein said clip upper end is arranged closer to said topmost end of said planar structure than said clip lower end, and wherein said clip lower end is arranged closer to said bottommost end of said planar structure than said clip upper end, wherein the hinge is arranged between said clip upper end and an upper section of the planar structure, the hinge allowing the clip to be foldable outwardly from the planar structure, stamping at least one longitudinal score line on which at least one side edge section of the planar structure can be folded to vary the width of the upper and/or lower sections of the planar structure, and not stamping any transverse score lines between said clip lower end and said bottommost end of said planar structure and closer to said clip lower end than to said bottommost end of said planar structure.

20. The method of claim 19, wherein said stamping also includes stamping of at least one transverse score line on which at least one end portion of the planar structure can be folded to vary the length of the planar structure, wherein said at least one transverse scored line is arranged between said clip lower end and said bottommost end of said planar structure and closer to said bottommost end of said planar structure than to said clip lower end.

* * * * *